US005143419A

United States Patent [19]

Tepper et al.

[11] Patent Number: 5,143,419

[45] Date of Patent: Sep. 1, 1992

[54] COLLAPSIBLE INFANT CARRIER WITH PIVOT-OPEN LOCK, PIVOT-CLOSED LOCK AND COAXIAL HANDLE LOCK

[75] Inventors: Sidney Tepper, Milburn, N.J.; Khipra Nichols, Rumford, R.I.

[73] Assignee: Playskool Baby, Inc., Pawtucket, R.I.

[21] Appl. No.: 767,828

[22] Filed: Sep. 30, 1991

[51] Int. Cl.[5] ..... A47C 4/52

[52] U.S. Cl. ..... 297/183; 297/131; 297/377; 297/270; 297/365

[58] Field of Search ..... 297/183, 130, 131, 258, 297/270, 310, 354, 355, 327, 337, 363-369, 373, 377-379, 316; 5/102, 105, 108; 224/159, 160, 161

[56] References Cited

U.S. PATENT DOCUMENTS 4,274,674 6/1981 Deloustal .
4,371,206 2/1983 Johnson, Jr. .
4,500,133 2/1985 Nakao et al. ..... 297/131
4,516,806 5/1985 McDonald et al. .
4,634,175 1/1987 Wise .
4,688,850 8/1987 Brownlie et al. .

*Primary Examiner*—Kenneth J. Dorner
*Assistant Examiner*—James M. Gardner
*Attorney, Agent, or Firm*—Salter, Michaelson & Benson

[57] ABSTRACT

An infant carrier includes a collapsible shell assembly including a seat and a backrest which are pivotally connected for movement between open and closed positions. The carrier further includes a latching assembly for locking the seat and the backrest in the open position, and a pivotable handle assembly which is coaxially oriented about the pivot axis of the seat and the backrest. The handle assembly includes a carrying handle and a pivot and locking mechanism for both locking the seat and the backrest in the closed position, and for locking the handle in a plurality of pivoted positions relative to the shell assembly.

8 Claims, 5 Drawing Sheets

COLLAPSIBLE INFANT CARRIER WITH PIVOT-OPEN LOCK, PIVOT-CLOSED LOCK AND COAXIAL HANDLE LOCK

BACKGROUND OF THE INVENTION

The present invention relates to infant seats and carriers, and more particularly to a collapsible infant carrier which folds into a compact unit for storage and transportation.

Various types of seats and carriers have been heretofore known for transporting and carrying infants. For example, the U.S. Pat. to McDonald et al Nos. 4,516,806; Wise No. 4,634,175; Brownlie et al No. 4,688,850; and Johnson, Jr. No. 4,371,206 disclose several types of heretofore available infant carriers. The infant carriers disclosed in these references generally comprise one-piece shells having seat portions and backrest portions which are oriented at fixed angles to one another. The U.S. Pat. to Deloustal No. 4,274,674, on the other hand, discloses an infant seat with a reclineable backrest portion, and the infant's seat disclosed in the above-mentioned U.S. Pat. to Wise further includes a rotatable handle which locks in various carrying, rocking, feeding, and sleeping positions.

Nevertheless, while the infant seats of the prior art have had their own advantageous features, they have generally been rather bulky, cumbersome, and unwieldy to carry. Further, they have generally been relatively large and of irregular configuration, and therefore they have been difficult to transport and store.

SUMMARY OF THE INVENTION

The present invention overcomes many of the disadvantages of the previously available infant carrying devices by providing a collapsible infant carrier which can be effectively utilized for transporting an infant and/or supporting an infant in various feeding, sleeping, and rocking positions, and which can be collapsed for transportation and storage. Specifically, the collapsible infant carrier of the present invention comprises a collapsible shell assembly including a seat and a backrest which are pivotally connected along an axis, a latching mechanism on the underside of the shell assembly for locking the seat and the backrest in an open position, and a handle assembly coaxially oriented about the same pivoting axis as the seat and backrest. The handle assembly comprises a carrying handle and a locking mechanism which serves a dual function of (1) locking the seat and backrest portions in a closed position and (2) locking the handle in a plurality of positions about the pivoting axis.

It is therefore an object of the instant invention to provide an effective collapsible infant carrier which can be folded into a compact structure for storage and transportation.

Another object of the instant invention is to provide an effective collapsible infant carrier including a collapsible shell and a handle assembly which is securable in a plurality of pivoted positions relative to the shell.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
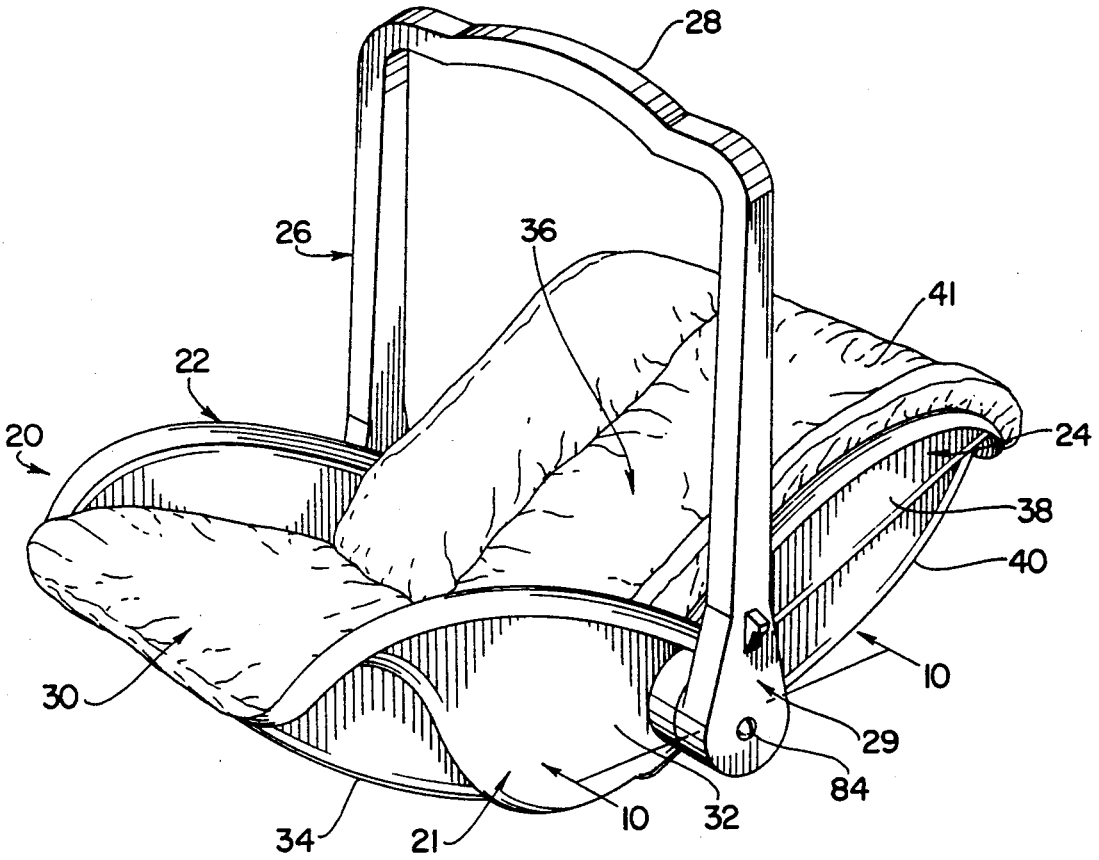
FIG. 1 a perspective view of the collapsible infant carrier of the instant invention.
Figure 2:
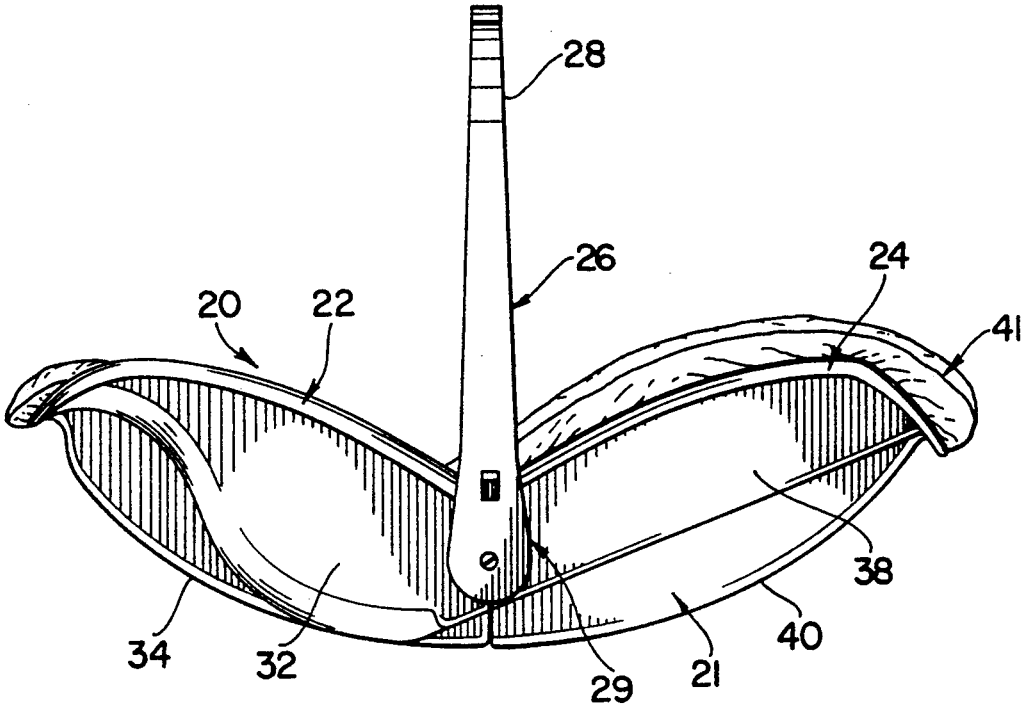
FIG. 2 is a side elevational view thereof in an open position.
Figure 3:
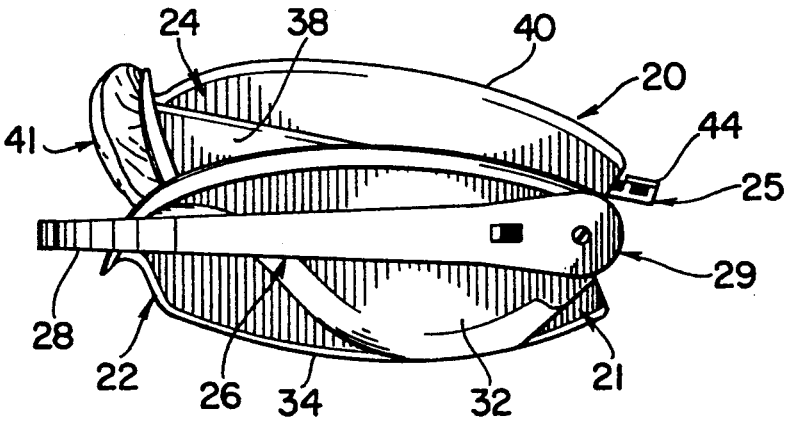
FIG. 3 is a side elevational view thereof in a closed position.

Referring now to the drawings, the collapsible infant carrier of the present invention is illustrated and generally indicated at 20 in FIGS. 1 through 3. The carrier 20 generally comprises a collapsible shell assembly 21 including a seat 22 and a backrest 24, a latching assembly 25 for securing the seat 22 and the backrest 24 in the open position illustrated in FIGS. 1 and 2, and a handle assembly 26 including a carrying handle 28 and a pivot and locking mechanism 29.

The collapsible shell assembly 21 comprises a seat 22 and a backrest 24 which are pivotally connected along a pivoting axis. The seat 22 and the backrest 24 are pivotable between the closed position illustrated in FIG. 3, wherein the seat 22 and the backrest 24 are in closely spaced, approximately parallel relation, and the open position illustrated in FIG. 2, wherein seat 22 and backrest 24 form an angle of greater than 90° therebetween. The seat 22 is preferably integrally molded from a durable plastic material and it comprises a seating wall 30, a pair of spaced sidewalls 32, and a pair of rockers 34 on the outer side of the wall 30. The backrest 24 is also preferably integrally molded from a plastic material, and it comprises a backrest wall 36, a pair of spaced sidewalls 38, and a pair of rockers 40 on the outer side of the wall 36. The collapsible shell assembly 21 further includes a removable liner pad 41 for cushioning an infant seated in the carrier 20.

Figure 4:
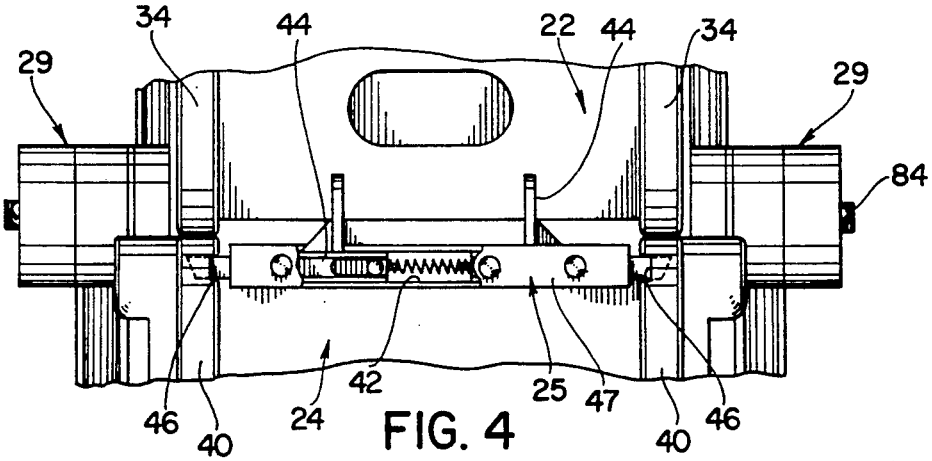
FIG. 4 is a fragmentary bottom view of the infant carrier with the latching mechanism in a locked position for locking the seat in an open position.
Figure 5:
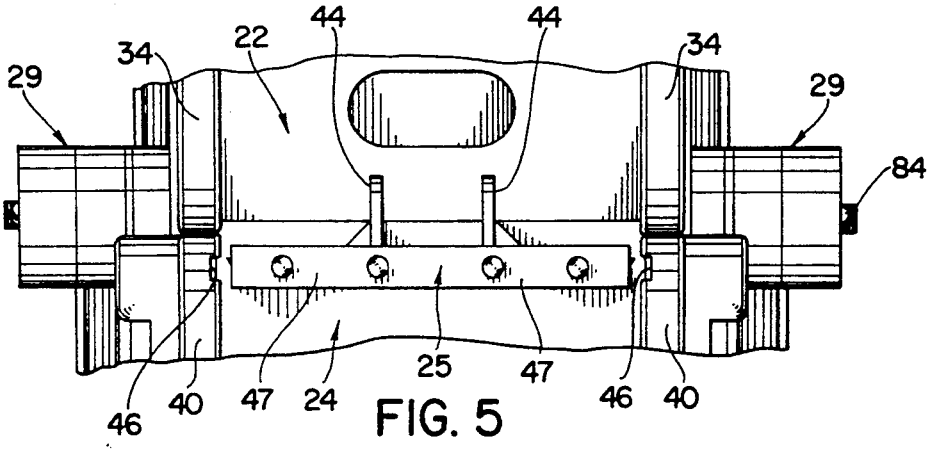
FIG. 5 is a similar view with the latching mechanism in an unlocked position.

Referring now to FIGS. 4 and 5, the latching assembly 25, which is operative for securing the seat 22 and the backrest 24 in the open position, comprises a track 42 located on the underside of the backrest 24, a pair of latch elements 44 which travel in the track 42, and a pair of slots 46 in the rockers 34 on the underside of the wall 30. The latch elements 44 are spring loaded in the track 42 so that they are biased to positions of engagement in the slots 46 for securing the seat 22 and the backrest 24 in the open position. The track 42 is preferably integrally formed on the underside of the backrest 24 and a cover section 47 is provided for partially enclosing the track 42.

Figure 10:
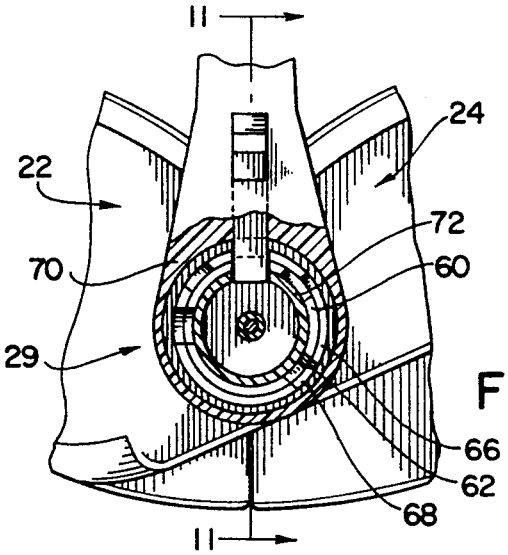
FIG. 10 is a side sectional view, showing the handle locking mechanism.
Figure 11:
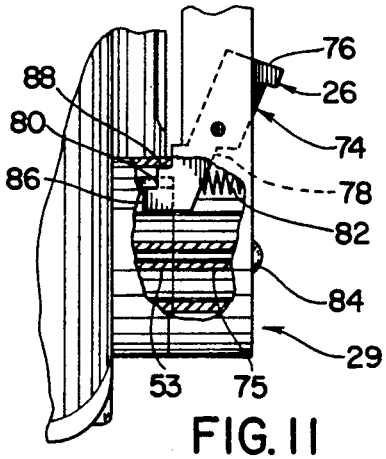
FIG. 11 is a sectional view of the handle locking mechanism as taken along line 11—11 of FIG. 10.
Figure 12:
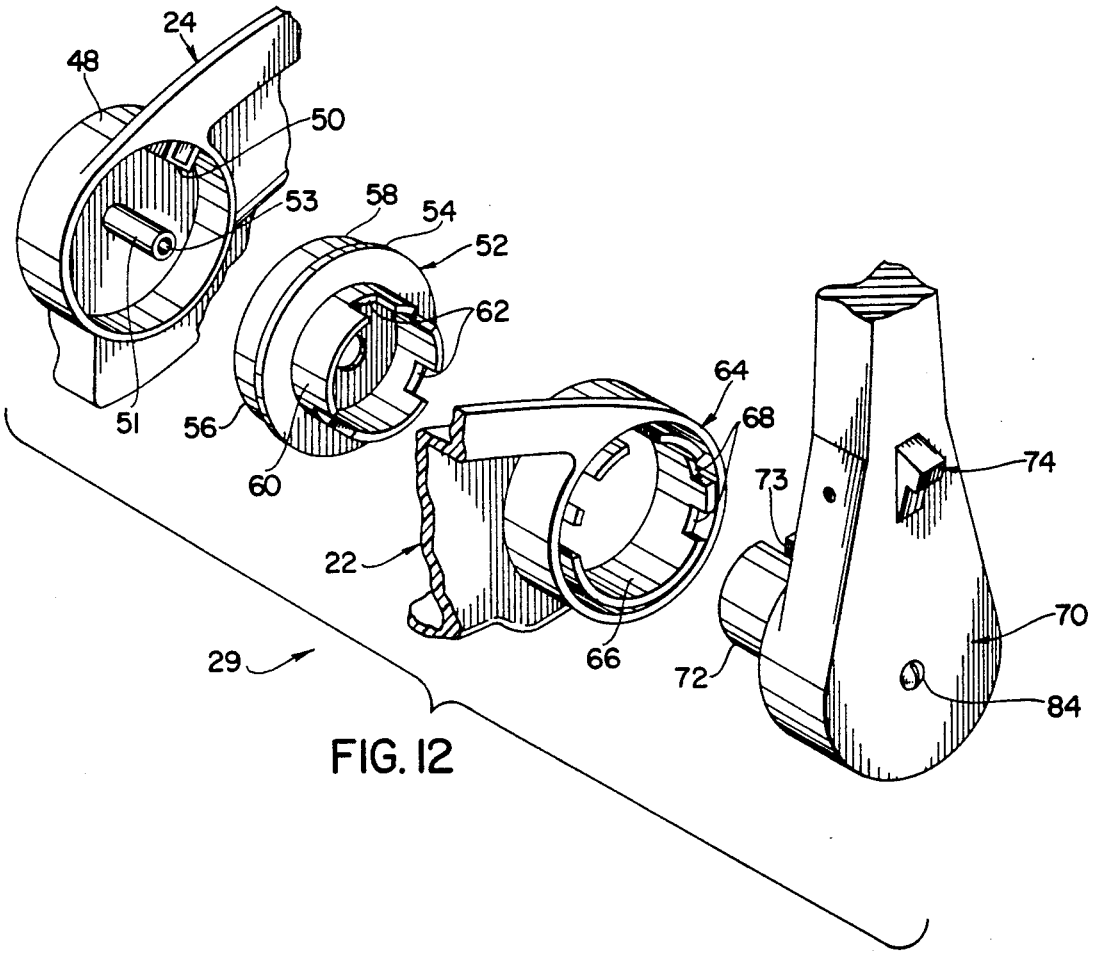
FIG. 12 is an exploded perspective view of the handle locking mechanism.

Referring now to FIGS. 10, 11, and 12, there is shown the pivot and locking mechanism 29 of the handle assembly 26. In this regard, it is pointed out that the seat 22 and the backrest 24 pivot about the same rotational axis as the handle assembly 26. It is also pointed out that the pivot and locking mechanism 29 of the infant carrier 20 includes a pair of subassemblies which are located on opposite sides of the collapsible shell assembly. Accordingly, referring first to FIG. 12, the pivot and locking mechanism 29 generally comprises a pair of subassemblies, each of which includes an outwardly extending cup 48 which is integrally formed with the adjacent sidewalls 38 of the backrest 24, a circular locking rim 52, an annular locking collar 64, a hubcap 70, and a spring-loaded locking lever 74.

Each of the cups 48 is coaxially oriented about the pivoting axis of the handle assembly 26, and each includes a locking tab 50 and a central hub 51. Each of the locking tabs 50 extends radially inwardly from the wall of cup 48 thereof, and a central hub 51 having a bore 53 therein extends axially inwardly along the pivoting axis.

Each of the locking rims 52 generally comprises a disc portion 54 having a central aperture therein and two circular walls 56 and 60 which extend outwardly from opposing sides of the disc portion 54 thereof. Each of the disc portions 54 is dimensioned to be rotatably received on the central hub 51 of cup 48 thereof. Each of the circular walls 56 extends inwardly from the disc portion 54 thereof toward the cup 48 thereof and each is dimensioned to be rotatably received in the wall of the cup 48 thereof. Each of the circular walls 56 further has a locking notch 58 formed therein for mating engagement with the locking tab 50 of the cup 48 thereof for preventing rotation of each of the locking rims 52 in the cup 48 thereof. Each of the circular walls 60 extends outwardly from the disc portion 54 thereof toward the locking collar 64 thereof and each has a plurality of spaced notches 62 formed therein. Each of the circular walls 60 is dimensioned to be rotatably received in the annular locking collar 64 thereof. It should be noted that each of the locking rims 52 remains in a fixed position relative to the adjacent sidewall 38 of the backrest 24 as a result of the locking tab 50 thereof and the locking notch 58 thereof, and it is therefore apparent that each of the circular walls 60 could alternatively be integrally formed with adjacent sidewall 38 of the backrest 24 and still achieve the same functional result.

Each of the annular locking collars 64 is integrally formed with the adjacent sidewall 32 of the seat 22, and each is coaxially oriented about the pivoting axis. Each of the locking collars 64 further includes an inner circular wall 66 having a plurality of spaced notches 68 formed therein.

Each of the hubcaps 70 is integrally formed with the handle 28 and each includes a drum portion 72 having an elongated notch 73. Each of the drum portions 72 is dimensioned to be rotatably received in the circular wall 60 of locking rim 52 thereof.

Situated within each of the hubcaps 70 is a spring loaded locking lever 74. Each of the locking levers 74 comprises an outer actuating portion 76 extending outwardly through the side of hubcap 70 thereof, an inner locking portion 78 including a stepped locking hammer 80 which is biased to a position of mating engagement with the spaced notches 62 and 68 of the respective locking rim 52 thereof and the respective annular looking collar 64 thereof with a lever biasing spring 82 (seen in FIG. 11). Each of the locking hammers 80 includes a lower hammer portion 86 and an upper hammer portion 88. Each of the hubcaps 70 further includes a central hub (not shown) extending axially inwardly along the pivoting axis and each has a bore 75 extending therethrough.

When the individual pieces of the pivot and locking mechanism are assembled together each piece engages its counterpart piece to form the arrangement as seen in FIGS. 10 and 11. A pivoting pin 84 is received in the aligned bores 53 and 75 along the rotation axis to hold the pivot and locking mechanism 29 together. When the pivot and locking mechanism 29 is assembled in this manner the spaced notches 62 and 68 form a tiered system of notches, wherein the notches 62 form an inner recessed tier and the notches 68 form an outer tier. Accordingly, each of the lower hammer portions 86 is receivable in engagement in the respective inner notches 62 thereof and each of the upper hammer portions 88 is receivable in engagement in the respective outer notches 68 thereof. The notches 62 and 68 are oriented so that specific ones thereof are in alignment at predetermined areas around the rotation axis for mating engagement of the hammer portions 86 and 88 of the locking hammer 80. Accordingly, when the hammer portions 86 and 88 are received in the notches 62 and 68 aligned therewith, the handle is locked in one of the various predetermined positions.

When the seat 22 and the backrest 24 are in the closed position the lower hammer portions 86 are received in engagement in notches 62 to lock the seat 22 in position, and the upper hammer portions 88 are received in engagement in the notches 68 to lock the handle 28 in position with respect to backrest 24, thereby locking the seat 22, the backrest 24, and the handle 28 in the closed position. Similarly, when seat 22 and the backrest 24 are in the open position the upper hammer portion 88 is received in engagement in the notches 68 for locking the handle 28 in its various positions and the lower hammer portion 86 is received in engagement in the notches 62.

When the seat 22 and the backrest 24 are in the open position they are secured in position by the latching assembly 25, so that the notches 62 aligned with the lower hammer portions 86 merely function as "dummy" notches or slots which allow the upper hammer portions 88 to pass into the notches 68 aligned therewith.

Figure 6:
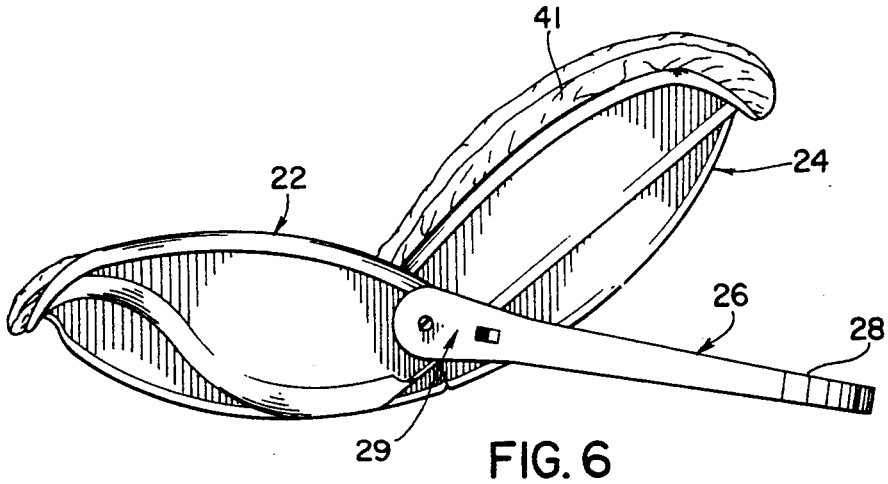
FIGS. 6 through 9 are side elevational views of the infant carrier with the carrying handle in various predetermined positions thereof.
Figure 7:
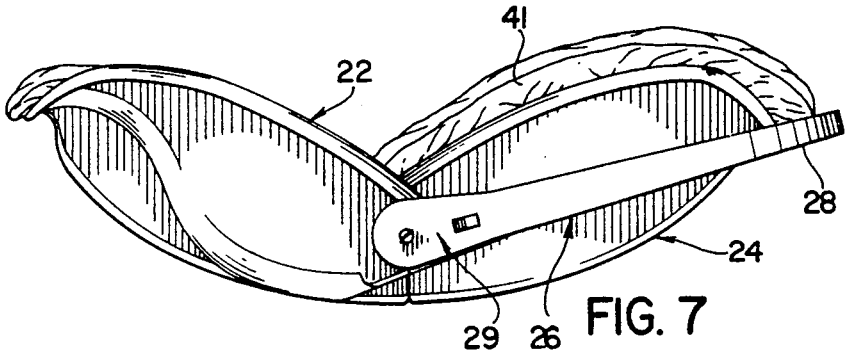
Figure 8:
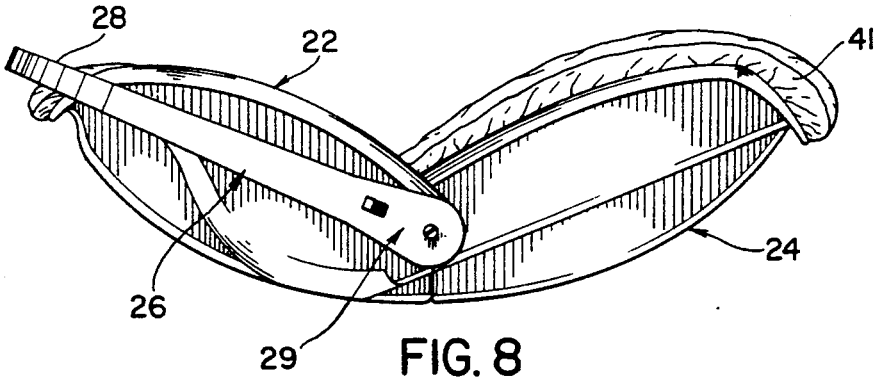
Figure 9:
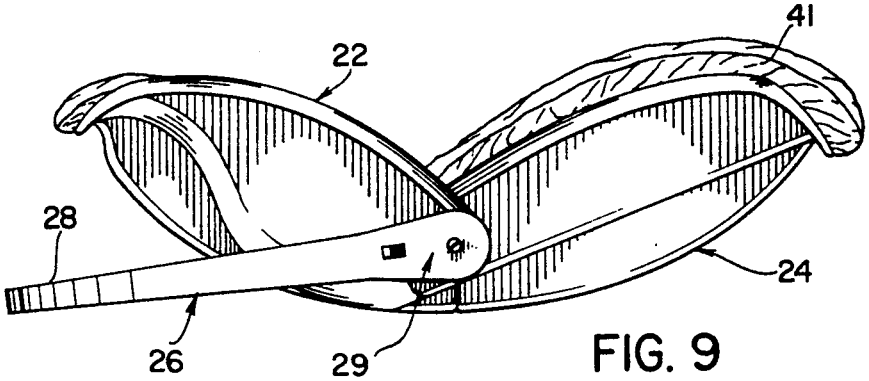

Referring now to FIGS. 2, 3, and 6 through 9, the various positions of the handle assembly 26 relative to the shell 21 are illustrated. As will be seen, the handle assembly 26 is securable in five different positions for different uses of the carrier 20. In this regard, in FIG. 2, the handle 28 is shown in a vertical carrying position, whereas in FIGS. 3 and 8, the handle 28 is shown in a neutral position wherein it is substantially coplanar with the seat 22, although in FIG. 3 the shell 21 is illustrated in the closed position thereof, whereas in FIG. 8 the shell 21 is illustrated in the open position thereof. In FIG. 6, the handle 28 is secured in a position wherein it is disposed to the rear of the backrest 24 for use of the carrier as a feeder, and in FIG. 7 the handle 28 is secured in a position wherein it is substantially coplanar to the backrest for use of the carrier as a rocker. In FIG. 9, the handle 28 is secured in a position wherein it is located forward of the seat 22 for use of the carrier 20 as a sleeper.

It is seen therefore that the instant invention provides an effective infant carrier which overcomes many of the disadvantages of the previously available infant carrying devices. The infant carrier 20 is effectively securable in open and collapsed positions, and the handle assembly 26 is securable in a plurality of positions relative to the shell assembly 21 to permit the carrier 20 to be readily transported and utilized in a variety of operative positions. Hence, it is seen that the infant carrier 20 represents a significant contribution to the art relating to infant seats and carriers.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An infant carrier comprising:

a collapsible shell assembly including a seat and a backrest which is pivotally connected to the seat along a pivot axis, said seat and said backrest being pivotable between a closed position wherein said seat and said backrest form an angle of less than 90°, and an open position wherein said seat and said backrest form an angle of greater than 90°;

means for locking said seat and said backrest in said open position;

means for locking said seat and said backrest in said closed position; and a handle assembly attached to said shell assembly and including a carrying handle which is pivotable about said axis, and a handle locking mechanism for locking said handle in a plurality of pivoted positions about said axis.

2. In the infant carrier of claim 1, said handle locking mechanism comprising:

an annular locking collar integrally formed with one of either said seat or said backrest and coaxially oriented about said pivot axis, said locking collar including an inner circular wall having a plurality of spaced notches formed therein;

a hubcap integrally formed with said carrying handle and coaxially oriented about said pivot axis, said hubcap including a drum portion rotatably received in said locking collar; and latch means on said handle receivable in said notches for locking said handle in a plurality of different pivoted positions about said axis.

3. In the infant carrier of claim 2, said latch means comprising a spring-loaded lever biased to a position of engagement in said notches.

4. In the infant carrier of claim 2, said means for locking said seat and said backrest in said closed position being coaxially oriented relative to said locking mechanism, said locking mechanism further comprising:

a circular locking rim having a plurality of spaced notches therein, said locking rim being integrally formed with said collapsible shell and coaxially oriented along said axis, said locking rim being received in said locking collar so that the notches of said locking rim are at least slightly recessed relative to the notches in said locking collar, said drum portion of said hubcap being received in said locking rim;

said latch means being simultaneously receivable in aligned notches in said locking rim and said locking collar for locking said seat and said backrest in said closed position and for locking said handle in predetermined positions relative to said shell assembly.

5. In the infant carrier of claim 4, said latch means comprising a spring-loaded lever having a stepped locking hammer biased to a position of engagement in aligned notches of said locking rim and said locking collar.

6. In the infant carrier of claim 1, each of said seat and said backrest including a main wall having an outer side, said infant carrier further comprising:

a first pair of spaced rockers integrally formed on the outer side of said seat; and a second pair of spaced rockers integrally formed on said underside of said backrest, wherein said first and second pairs of spaced rockers matingly align to form a unitary pair of continuous rockers when said seat and said backrest are in said open position.

7. In the infant carrier of claim 1, said means for locking said seat and said backrest in said open position comprising:

track means on one of said seat or said backrest;

latch means traveling in said track means; and at least one slot on the other of said seat or said back rest, said latch means being receivable in said at least one slot for securing said seat and said backrest in an open position.

8. In the infant carrier of claim 1, said seat and said backrest being in closely spaced and approximately parallel relation when said seat and said backrest are in said closed position.

* * * * *